United States Patent [19]

Krabbe et al.

[11] 4,249,870

[45] Feb. 10, 1981

[54] CLIMBING FRAMEWORK FOR ERECTING CONCRETE FORMS IN THE MANUFACTURE OF STRAIGHT OR CURVED REINFORCED CONCRETE WALLS

[75] Inventors: Wilfried Krabbe, Buchschlag; Walter Simon, Frankfurt am Main, both of Fed. Rep. of Germany

[73] Assignee: Philipp Holzmann AG, Frankfurt am Main, Fed. Rep. of Germany

[21] Appl. No.: 974,395

[22] Filed: Dec. 29, 1978

[30] Foreign Application Priority Data

Dec. 30, 1977 [DE] Fed. Rep. of Germany ..... 2759088

[51] Int. Cl.[3] ..... B28B 19/00

[52] U.S. Cl. ..... 425/63; 264/33; 425/65

[58] Field of Search ..... 425/63, 65; 264/33, 264/34

[56] References Cited

U.S. PATENT DOCUMENTS

| | | | |
|---|---|---|---|
| 2,150,830 | 3/1939 | Hallisy | 264/33 |
| 3,659,978 | 5/1972 | Svennson | 425/63 |

FOREIGN PATENT DOCUMENTS

| | | | |
|---|---|---|---|
| 2452182 | 6/1976 | Fed. Rep. of Germany | 425/63 |
| 2521622 | 11/1976 | Fed. Rep. of Germany | 425/65 |
| 1385571 | 2/1975 | United Kingdom . | |

*Primary Examiner*—John Parrish

[57] ABSTRACT

The invention provides a climbing framework for erecting concrete forms in the manufacture of straight or curved reinforced concrete walls, with anchoring members for removably anchoring the climbing framework to the wall, and with anchoring elements which as the wall is built, section by section, can be detached from one section and moved up for manufacture of the next-higher section.

12 Claims, 3 Drawing Figures

CLIMBING FRAMEWORK FOR ERECTING CONCRETE FORMS IN THE MANUFACTURE OF STRAIGHT OR CURVED REINFORCED CONCRETE WALLS

Climbing frameworks and scaffolding for erecting concrete forms along high concrete walls are especially useful in the manufacture of tall buildings, particularly conical buildings with curved reinforced concrete walls that are curved on each side and are of varying wall strength, for example, cooling towers for power stations.

Climbing concrete form-laying devices of the previously known type include climbing platforms, climbing tracks, framework tracks, and concrete form-making panels of wood or metal. The climbing platforms together with the laid-out planking make up the working and protected platforms, and are removably attached to the already built reinforced concrete wall by the anchoring devices. The concrete form-making framework is independent of the climbing framework, and is made of wood or metal form framework elements which extend between the platforms. As erecting devices to move the framework, there are used cranes, or hydraulically, or electrically, or pneumatically operated devices. In the known processes, the concrete form is built up by insertion of wooden panels which are made to fit by being trimmed to size, as a result of which the cut off material is lost. When metal form elements are used, the fit is obtained by use of adapters and overlapping or telescoping the respective form-making panels.

The disadvantage of the known climbing concrete form-making frameworks is that the working and protective erecting scaffolding and the form-laying framework are entirely separate from each other, and are carried up along the wall one at a time on their own climbing scaffolding tracks and form-laying framework tracks so that to anchor the climbing tracks and the framework tracks is necessarily very time consuming. Furthermore, in order to construct the building by moving the framework along its periphery, a supporting structure must be set up, with correspondingly added labor and material costs. If the supporting structure is itself unstable, it must be stabilized by the addition of lateral reinforcements.

German Offenlegungsschrift No. 2,140,543 discloses a climbing framework for the preparation of straight or curved reinforced concrete walls with the inner and outer concrete forms in one, in which the top of the scaffolding extends over the top of the building wall, and in which the inner and outer forms after the concreting of a section of the building are released from their anchorage in the already erected building wall, and one after another, with the help of erecting devices, are hoisted up to the top of the wall, and again anchored. The top of the scaffolding is composed of frame supports which include vertical supports along the inner or outer wall, which are joined together above the concrete building wall by a horizontal support. The vertical supports are carried telescopically in the inner or outer concrete forms. Hydraulic lifting devices are further provided, which, while gripping the erected concrete wall, carry the frame supports to the top, and which, in gripping the frame supports, carry up the inner or outer concrete forms.

With the use of this known elevating and positioning device with a top scaffolding, the climbing scaffolding framework can be carried to the top of both the inner wall and the outer wall simultaneously. During this erection of the climbing scaffolding, the concrete form-laying, reinforcing and concrete-pouring work come to a halt, inasmuch as the concrete form-laying framework never can be moved at the same time as the climbing scaffolding. Furthermore, the concrete form height of this known elevating and positioning device is limited to 1.2 meters because of the design of the climbing scaffolding, so that a quicker construction rate is inhibited. Finally, the frame supports have to be provided with an attached dependent scaffolding.

The invention has as its objective a climbing framework and concrete form-erecting apparatus capable of erecting straight or curved reinforced concrete walls for tall buildings in a time saving and continuous work flow, and thereby makes possible a rapid building construction rate.

These objectives are realized in accordance with the invention by way of a climbing framework and concrete form-erecting apparatus different from the known type (1) in that the climbing framework is provided with at least one scaffold tower, and at least one sliding frame for each scaffold tower;

(2) in that the scaffold tower and the sliding frame during the reinforcing and concrete-pouring operation of the next wall portion can be removably attached to the just-erected wall portion; and (3) in that during the erection of the climbing framework, the scaffold tower can be moved with respect to the first firmly anchored sliding frame and, correspondingly, the sliding frame can be moved with respect to the next firmly anchored scaffolding tower, by way of elevating elements such as a spindle and rack gear mechanism.

The advantages of the invention lie primarily in the fact that the elevation of the scaffold tower results from a relative displacement with respect to the sliding frame, and vice versa, and that the scaffold tower on the inside of the concrete wall is separated from the scaffold tower on the outside of the concrete wall, and each is separately elevatable to the top, so that when the climbing scaffolding is moved up, the associated anchoring elements can also be moved with them, with the result that a continuous concreting operation is obtained.

Furthermore, the sliding frames and the scaffold towers, although adjacent the building wall, are connected without the installation of climbing tracks or the like, whereby a saving in material and work time in the anchoring of the climbing framework is obtained.

According to one embodiment of the invention, the scaffold towers, as well as the sliding frames, are built as a spacious framework projecting from the wall on which they are mounted, and constitute a stable right-angled or square-shaped form in cross section over their total height, with an entirely open inner space. Each of the scaffold towers is independent of other scaffold towers, and is individually movable with respect thereto. As a result of the building out of the sliding framework and scaffold towers in a spacious projecting framework, it is possible to obtain a working height of 2 meters for each increment of height of the concrete form framework, which, as compared to known climbing frameworks affords a quicker construction rate.

Especially preferred are scaffold towers which slide within the vertical side walls of the sliding frames, which are carried on carriages on wheels placed on the vertical corner supports of the sliding frames, and which slide against bearing surfaces on the corner supports of the scaffold towers, in order to make possible a relative friction-free movement in the linear direction between the scaffold towers and the sliding frames.

On the scaffold towers and on the sliding frames are provided on one side, at a predetermined distance from the lower frontal area, anchoring elements which face outwardly, with fastening means for anchoring in the anchoring points that are previously placed in the reinforced concrete wall at selected locations in the upper wall sections. In this way, the anchoring positions for the sliding frame and the scaffold towers are located in a portion of the wall which has sufficient strength for the supporting need. The anchoring elements for the inner side of the wall and the anchoring elements for the outer side of the wall, in accordance with the invention, are interconnected by way of through connections in the wall with heavy load-supporting bracings, so that the pressure of the concrete is accepted by the bracings, and, with the exception of an existing horizontal component through the slanting incline of the concrete form supports, is not diverted to the climbing scaffolding. Because of the through connections, a part of the gripping anchoring points can be used for the fastening and anchoring of the sliding frames and scaffold towers.

According to an especially preferred embodiment of the invention, the scaffold towers and sliding frames at a predetermined distance from their lower frontal area are provided with working and protective platforms which extend parallel to the building wall and horizontally with respect to the adjacent sides of the scaffold towers as well as the sliding frames over a selected length, and which conform to the required safety specifications as, for example, for railing and plank edges. The reciprocable climbers of the scaffold towers have the advantage that the working and protective platforms which extend parallel and horizontally along the building wall can be positioned without having to be rebuilt over entire building sections, and that the scaffolding platforms as compared to known climbing frameworks are in a parallel position to the wall and always horizontal, without any inclined sections which constitute danger areas.

Within the scaffold tower there is arranged a climbing route such as rungs or steps which makes possible access to the working and protective platforms.

As raising elements for the elevation of the sliding frames with respect to the attached scaffold towers, there are provided electrically or hydraulically operated spindle gear elements, which also can serve to elevate the scaffold towers with respect to the attached sliding frames. The use of spindle gear elements has the advantage of permitting a jerk-proof and vibration free operation, which avoids undue stresses on the freshly built and usually still weak building wall.

In the case of buildings with curved walls whose curvatures differ on each side, such as, for example, conical cooling towers for nuclear power plants, and which require a special positioning of the scaffold towers that conforms to the shape of the building, screw spindles are used which are components of the fastening devices attached to the anchoring elements of the sliding frame and scaffold towers, and are installable manually, whereby the anchoring of the scaffold towers and sliding frames is obtained by way of connecting elements which are screwed into conical sockets in the concrete wall. The use of conical sockets for supporting the weight of the framework on the building wall is advantageous because of the greater pressure distribution surface, as compared to normal round bar steel supports or connections. Furthermore, whereas slippage of long, round bar steel connections occurs after the elevation of the scaffold towers or sliding frames, it is only necessary, in accordance with the invention, simply to screw short screws into the cones, as a result of which there is a saving of labor, and the danger of accidents is reduced.

Especially preferred as concrete form-making elements are vertical main form-making elements for the placement of vertical concrete ribs of a constant width, and also vertically extending fill-in form-making elements which are placed near the main form elements and, due to a small reduction in the width of fill-in form-making elements, lie partly behind the main form-making elements, and can be taken out. The main concrete form elements and the fill-in concrete form elements are propped up with horizontally extending steel girders of variable lengths which are connected to the form elements, and are carried at their ends on sliding tracks which are attached in the scaffold towers. In this way the main and fill-in concrete form-making elements, after the placing of the scaffold towers at the correct height, and their adjustment by way of the anchoring elements without separation from the scaffold towers can be raised to the working level with independent elevating devices. Especially preferred are main form-making elements which are placed within the scaffold towers and firmly attached thereto, so that the main form-making elements are elevated together with the scaffold towers.

The invention is further illustrated by way of the Example thereof which is shown in the drawings, of which:

Figure 1:
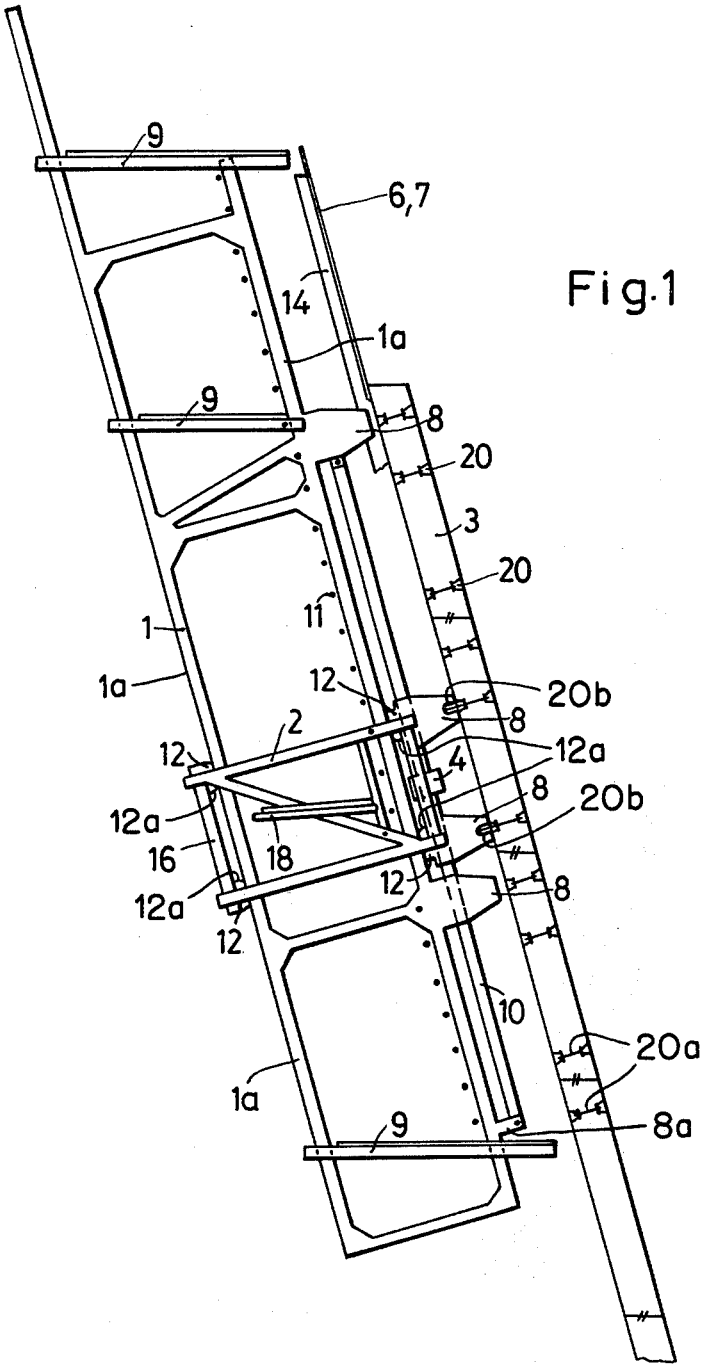
FIG. 1 represents a side view of a combination of scaffold tower and sliding frame in accordance with the invention, in position on one side of an inclined concrete wall.
Figure 2:
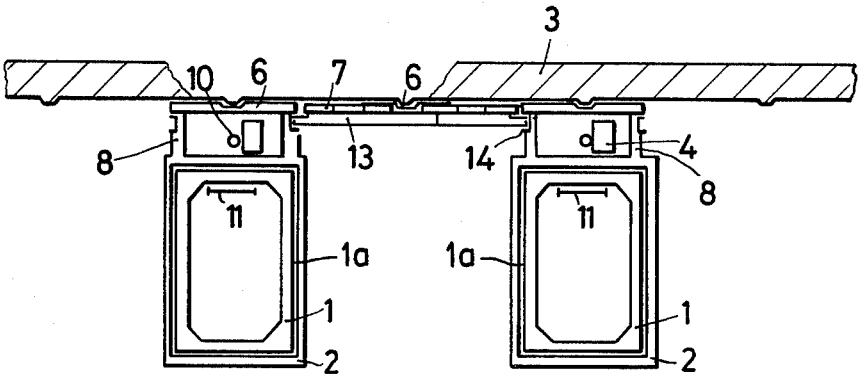
FIG. 2 represents a view in section of the climbing framework of the invention shown in FIG. 1, and seen from above.
Figure 3:
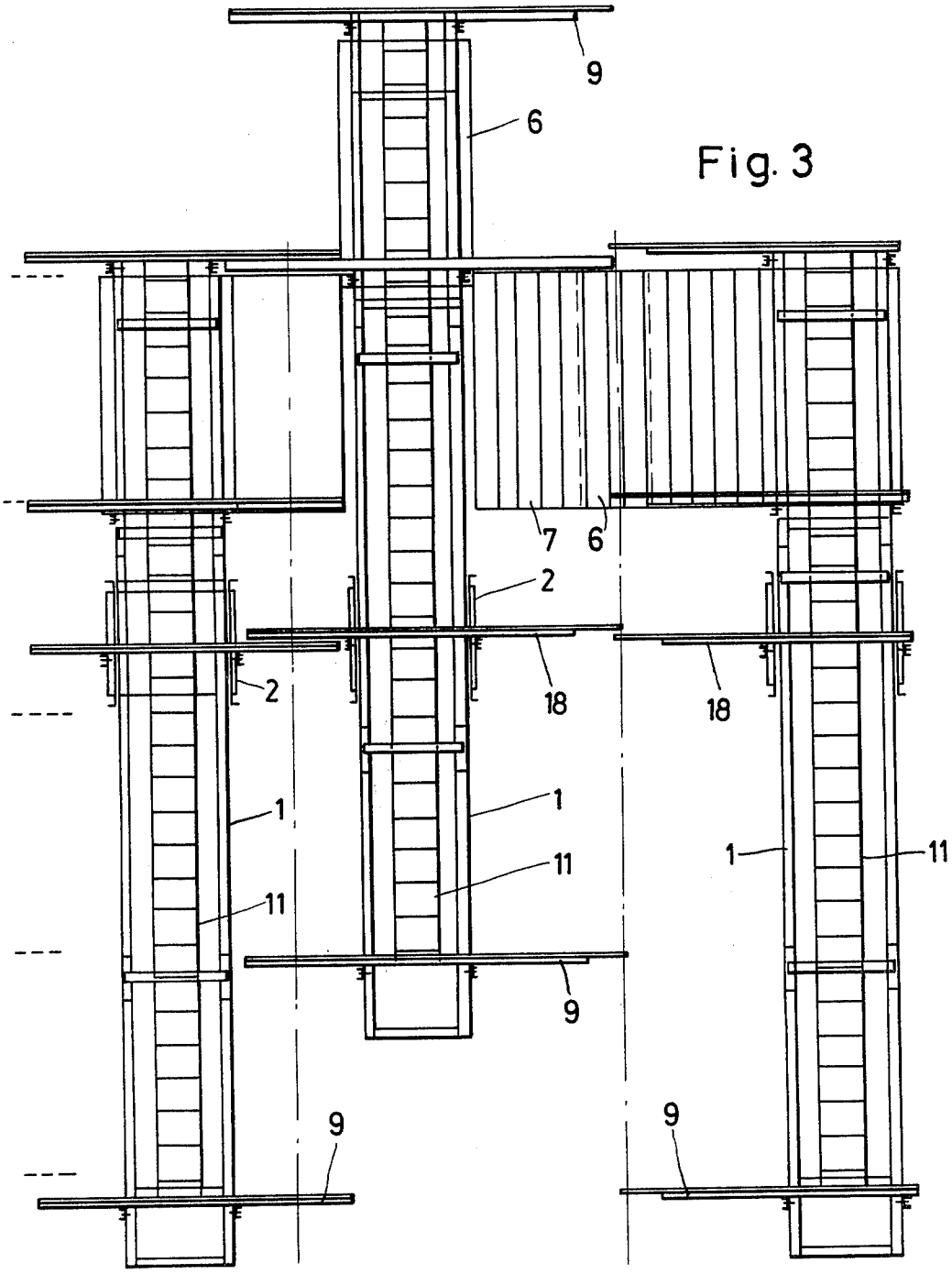
FIG. 3 represents a front view of an almost perpendicular concrete wall on which is placed a section of the climbing framework shown in FIGS. 1 and 2.

In FIGS. 1 to 3 a section of a reinforced concrete wall 3 is shown, which is inclined upwardly and outwardly and which, in this Example, is a part of the wall of a conical cooling tower for a power plant. The wall has on each side many framework mooring locations 20, which are placed in pairs opposite each other on each side of the wall, in an inclined position, and which are in the form of conical sockets with inside threads. The pairs of sockets are connected to each other by means of a bracing 20*a*.

On each side of the reinforced concrete wall 3 (only one is shown in FIG. 1) and projecting outwardly therefrom is a scaffold tower 1, which is constructed as a spacious reinforced framework, with a right angle or square cross section design. On the framework 1 is a carriage 12, which rolls on wheels 12*a* along the framework for linear movement of a sliding frame 2 along the wall 3.

The sliding frame 2 has anchoring elements 8 on the wall side thereof at its upper and lower ends. The anchoring elements are removably fastened to the wall 3 at anchoring places 20 by way of screws or spindles 20*b*.

The scaffold tower 1 also has anchoring elements 8 at a predetermined distance from its lower edge, which are also removably fastened to the concrete wall by screws or spindles 20*b* in anchoring places 20.

The wheels 12*a* for the sliding frame 2 are placed on the ends of the corner supports 16 of the sliding frame 2, and move against the corresponding outside bearing surface, constituting a track, on the frame supports 1*a* of the scaffold tower 1, and in this manner provide for a smooth relative movement between the scaffold tower 1 and the sliding frame 2.

The relative linear movement of the sliding frame 2 along the scaffold tower 1 arises by movement of the spindle gear element 4 along the toothed rack gear 10, which extends between the element 8 of the scaffold 1 and the lug 8*a* on the lower part of the scaffold, outside the framework of the scaffold tower 1, parallel to the wall 16 of the scaffold tower. The spindle and rack gear elements 4, 10 are operated by way of an electric motor, which is not shown.

Within the scaffold tower 1 there are a series of rungs or steps 11 which give access to the individual working and protected platforms 9, which are laid out horizontally in selected locations along the length of the scaffold tower 1, parallel to one another, and to the wall 3 (see especially FIG. 3). A corresponding working and protected platform 9 is also provided in the sliding frame 2, and extends parallel to and horizontally along the wall, over the breadth of the sliding frame. These working and protected platforms 9 are provided with railings and platform edges (which are not shown) and which are securely attached to the scaffold tower 1 or sliding frame 2.

In connection with the just-built wall section, or in the next-to-be-built wall section, are the concrete form-making elements 6 and 7, which take the form of essentially vertically extending main form elements 6, shaped for the preparation of vertical concrete ribs of constant width, and also essentially vertically extending fill-in concrete form-making elements 7, which are placed near the main form elements 6, and by a reduction of the width of the form elements or the circumference of the building, lie behind the principal form elements 6, and are removable from the concrete form framework after the concrete that is poured into the completed form has set.

The concrete form-making elements 6, 7 have a maximum height of about 2 meters, representing the maximum incremental height of each wall section that is to be built, and are propped up by steel girders 13, which have a variable length, against the wall 3. The steel girders 13 run essentially horizontally, and during the height adjustment and during the construction of the concrete form and the concrete pouring are carried on the sliding tracks 14 which are attached on opposite sides of the scaffold towers along the concrete wall 3. For the erection of the form elements, elevating elements are used (not shown) which pull up the form elements 6, 7 together with the steel girders 13 that support the form elements 6, 7.

As best shown in FIG. 3 there is one main form element 6 beside each side of each scaffold tower, and attached to the corresponding scaffold tower, so that this main form element is carried along with the scaffold tower after each wall section is completed.

After the positioning of the form elements 6, 7 at the top of the wall 3, the form framework (which is reinforced through reinforcing elements and which is bound together by means of screws in steel-plated locating boards) can be shortened in the horizontal direction, if necessary, through the removal of surplus fill-in form elements. The concrete form-making elements on the inside of the concrete wall can be attached to the form-making elements on the outer side of the concrete wall by connectors with heavily weighted bracings, by way of the anchoring places 20 which are also used for the fastening and anchoring of the sliding framework 2 and the scaffold tower 1.

During the placing of the form-making elements and the following reinforcing and concrete-pouring operations, the scaffold tower 1 as well as the sliding frames 2 are firmly anchored in the previously laid section of concrete wall. There then follows the raising operation by way of the spindle-raising elements 4, 10. First, the scaffold tower 1 on the inner side and then on the outer side, alternately, one after the other, are raised in the sliding frame 2 as work proceeds in erecting this section of wall, while the sliding frame 2 during this work operation remains securely fastened to the reinforced concrete wall 3 by way of the anchoring elements 8. There then follows the fastening of the raised scaffold tower 1 to the concrete wall 3, and the detachment of the sliding frame 2 from the concrete wall, which then is elevated by way of the spindle-raising elements 4, 10, and then again attached to the concrete wall 3, in the course of which the previously set towers 1 serve as carriers. After the raising to the top, the scaffold towers 1 and the sliding frames 2 are set in the anchoring elements 8 by way of the screw spindles, so that they are adjusted to the desired wall height.

Beside and to each scaffold tower 1 is fastened a vertically extending main form element 6, so that it is moved during the raising of the corresponding scaffold tower. Immediately after two adjacent climbing scaffold towers 1 are brought to the same level on the side of the concrete wall, the fill-in form elements 7 can be placed between the adjoining climbing scaffold towers by way of the independent raising devices in the sliding tracks 14, for laying the next wall section.

The climbing framework of the invention makes possible an easy installation of reinforcing construction for the inner side and the outer side of a concrete wall 3 either separately or together. The independent raising of the climbing framework and the climbing scaffolding on the inner and the outer sides of the wall 3 makes possible a continuous and improved work operation.

Having regard to the foregoing disclosure, the following is claimed as inventive and patentable embodiments thereof:

1. A climbing framework and concrete form-erecting apparatus capable of erecting straight or curved reinforced concrete walls for tall buildings in a time saving and continuous work flow at a rapid building construction rate, comprising:

(1) a climbing framework including at least one scaffold tower, and at least one sliding frame for each scaffold tower; the sliding frame having vertical side walls within which the scaffold tower slides, and the scaffold tower and sliding frame being built as a spacious framework having an open interior and projecting from a wall on which they are mounted;

(2) means for removably attaching the scaffold tower and the sliding frame to a previously-erected wall portion, each independently of the other, for the form-erecting, reinforcing and concrete-pouring operation of the next wall portion;

(3) guide means on the framework along which each of the scaffold tower and the sliding frame can be moved reciprocably and independently, each with respect to the other, so that if either be attached to the wall while the other is detached, the detached one can be moved up or down along the guide means and attached to the wall in a different position, and the other can then be detached and moved along the guide means to a different position, and attached to the wall there; and (4) means for moving the detached one with respect to the attached one along the guide means, whereby the elevation of the scaffold tower along the wall results from a relative displacement of the scaffold tower with respect to the sliding frame, and vice versa.

2. A climbing framework according to claim 1 in which the means for moving the detached one is a spindle and rack gear mechanism.

3. A climbing framework according to claim 1 in which the scaffold tower and sliding frame carry therewithin a working platform from which concrete form-erecting and reinforcing and concrete-laying operations can be carried out.

4. A climbing framework according to claim 1 in which the framework constitutes a stable right-angled and square-shaped form in cross section over its total height, with an entirely open inner space.

5. A climbing framework according to claim 1 in which the sliding frame is carried on a carriage on slides placed on the vertical corner supports of the sliding frame, and which slide against bearing surfaces on the corner supports of the scaffold tower, in order to make possible a relatively friction-free movement in the linear direction between the scaffold tower and the sliding frame.

6. A climbing framework according to claim 1 in which the scaffold towers and the sliding frames carry anchoring elements which face towards the wall and have fastening means for anchoring in the anchoring points in the previously-erected wall portion.

7. A climbing framework according to claim 6 in which climbing frameworks are disposed on each side of the previously-erected wall portion, and the anchoring elements for the framework on the inner side of the wall and the anchoring elements for the framework on the outer side of the wall are interconnected by way of through load-supporting connections.

8. A climbing framework according to claim 1 in which the scaffold towers and sliding frames at a predetermined distance from their lower frontal area are provided with working and protective platforms which extend parallel to the building wall and horizontally with respect to the adjacent sides of the scaffold towers and the sliding frames.

9. A climbing framework according to claim 1 in which the scaffold tower comprises therewithin a climbing route which makes possible access to the working and protective platforms.

10. A climbing framework according to claim 1 in which the attaching means comprise screw spindles attached to the anchoring elements of the sliding frame and scaffold towers, and are installable into conical sockets in the concrete wall.

11. A climbing framework according to claim 1 comprising as concrete form-making elements vertical main form-making elements for the placement of vertical concrete ribs of a constant width, and vertically extending fill-in form-making elements placed between the main form elements.

12. A climbing framework according to claim 11 in which the main form-making elements and fill-in form-making elements are propped up with horizontally extending steel girders of variable lengths which are connected to the form elements, and are carried at their ends on sliding tracks which are attached in the scaffold towers.

* * * * *